United States Patent [19]

Ueno et al.

[11] Patent Number: 4,639,151

[45] Date of Patent: Jan. 27, 1987

[54] ELECTRONIC TYPEWRITER WHICH PRINTS SELECTED PORTIONS OF A TEXT

[75] Inventors: Hideo Ueno; Hiroshi Kuno; Yoshifumi Hamabe, all of Nagoya, Japan

[73] Assignee: Brother Kogyo Kabushiki Kaisha, Aichi, Japan

[21] Appl. No.: 670,021

[22] Filed: Nov. 9, 1984

[30] Foreign Application Priority Data

Nov. 18, 1983 [JP] Japan ..... 58-218409

[51] Int. Cl.[4] ..... B41J 5/30

[52] U.S. Cl. ..... 400/63; 400/61; 400/76

[58] Field of Search ..... 400/61, 63, 70, 76, 400/279, 695, 696, 697

[56] References Cited

U.S. PATENT DOCUMENTS 3,940,746 2/1976 Vittarelli ..... 400/63

4,016,365 4/1977 Staar ..... 400/63

4,504,825 3/1985 Bergermann et al. ..... 400/83

*Primary Examiner*—Edgar S. Burr

*Assistant Examiner*—David A. Wiecking

*Attorney, Agent, or Firm*—Parkhurst & Oliff

[57] ABSTRACT

An electronic typewriter with data storage and editing capability having a keyboard for entering printing data including character data representative of a text, a text memory for storing the character data from the keyboard, and a printing assembly for printing the stored text according to the printing data. The typewriter comprises a first control device for printing all lines of characters of the text stored in the text memory, a designating device for designating in an editing mode a group of character data corresponding to a desired line of characters of the stored text, a second control device for printing only the desired single line of characters designated by the designating device, and a third control device for printing the designated and all subsequent lines of the stored text.

5 Claims, 3 Drawing Figures

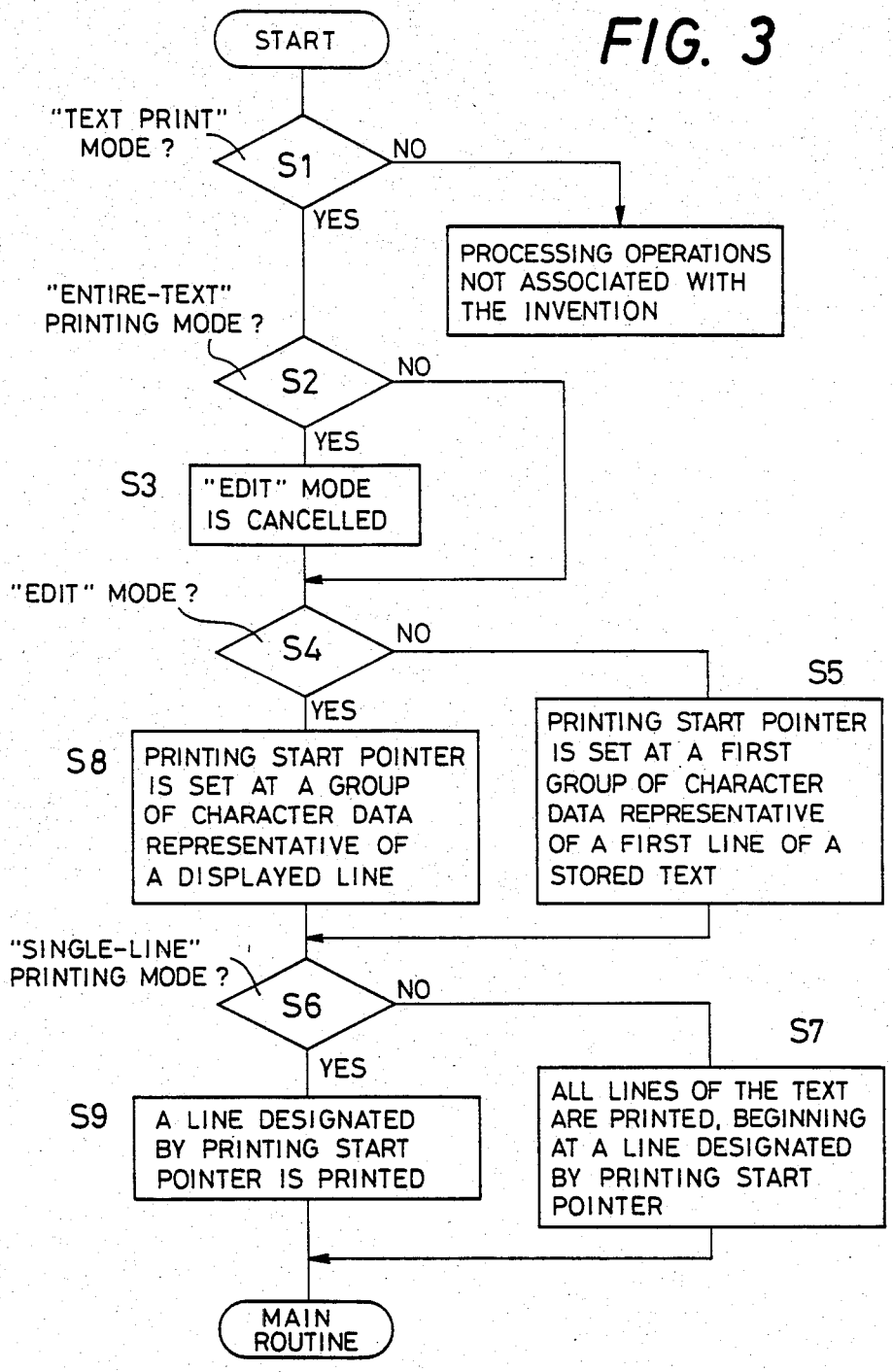
FIG. 3
START
"TEXT PRINT" MODE ?
S1
NO
YES
PROCESSING OPERATIONS NOT ASSOCIATED WITH THE INVENTION
"ENTIRE-TEXT" PRINTING MODE ?
S2
NO
YES
S3
"EDIT" MODE IS CANCELLED
"EDIT" MODE ?
S4
NO
YES
S5
PRINTING START POINTER IS SET AT A FIRST GROUP OF CHARACTER DATA REPRESENTATIVE OF A FIRST LINE OF A STORED TEXT
S8
PRINTING START POINTER IS SET AT A GROUP OF CHARACTER DATA REPRESENTATIVE OF A DISPLAYED LINE
"SINGLE-LINE" PRINTING MODE ?
S6
NO
YES
S7
ALL LINES OF THE TEXT ARE PRINTED, BEGINNING AT A LINE DESIGNATED BY PRINTING START POINTER
S9
A LINE DESIGNATED BY PRINTING START POINTER IS PRINTED
MAIN ROUTINE

ELECTRONIC TYPEWRITER WHICH PRINTS SELECTED PORTIONS OF A TEXT

BACKGROUND OF THE INVENTION

The present invention relates generally to an electronic typewriter having data storage and editing capability, and more particularly to such an electronic typewriter capable of printing only a single line of characters of a text which is stored in a text memory in the form of plural groups of character data representative of corresponding plural lines of characters of the text.

An electronic typewriter is known in the prior art, which has a text memory for storing a batch of character data that are transferred from a keyboard and representative of multiple lines of characters forming a text or document. Usually, such an electronic typewriter is operable in an edit mode wherein it is possible to edit the stored character data through the keyboard, so that the edited text is printed out. In this type of typewriter, the printing of the stored text is effected in one of two selectable printing modes. In one printing mode, all lines of the stored text, i.e., the entirety of the text is printed. In the alternative mode, the printing of the text is started at a desired line part way through the text. For example, a predetermined number of lines as counted from the beginning of the text are not printed and the remaining all lines are printed. However, the known typewriter indicated above is not capable of printing only a desired single line of character of a stored text. In the case where a previously stored text is edited for some changes, there sometimes arises a need of printing only a single line of the edited text for some reason or other.

SUMMARY OF THE INVENTION

It is therefore an object of the present invention to provide an electronic typewriter which is capable of printing only a single line of characters of a text stored in a text memory in the form of plural groups of character data representative of corresponding lines of characters forming the text.

According to the present invention, there is provided an electronic typewriter with data storage and editing capability, having a keyboard for entering printing data including character data representative of a text, a text memory for storing the character data from the keyboard, and a printing assembly for printing the stored text according to the printing data, the typewriter being operable in an editing mode to edit the printing data, and comprising first control means, designating means and second control means.

The first control means controls the operation of the typewriter so as to print all lines of characters of the text stored in the text memory. The designating means serves to designate, in the editing mode, a group of character data corresponding to a desired line of characters of the text stored in the text memory. The second control means controls the operation of the typewriter so as to print only said desired line of characters which is designated by the designating means.

In the electronic typewriter of the invention constructed as described above, the printing assembly is operated to print the entire text stored in a text memory, under control of the first control means. In addition, only a single line of the stored text which is designated by the designating means while in the editing mode, can be printed by the printing assembly under control of the second control means.

According to one preferred embodiment of the invention, a display is provided for indicating at least a portion of a line of characters represented by one of plural groups of the character data which represent corresponding plural lines of characters constituting the text. Further, the keyboard comprises operator-controlled means for effecting a scrolling operation to select said one of plural groups of the character data for displaying the corresponding line of characters on the display. The group of character data corresponding to the desired line of character to be solely printed is designated when this desired line of character is displayed on the display as a result of the scrolling operation of the operator-controlled means. In this case, therefore, the designating means includes the operator-controlled means.

In one form of the above embodiment, the operator-controlled means comprises at least one cursor key and a function key provided on the keyboard. The scrolling operation to display a selected line of characters is effected by simultaneous activation of the cursor key and the function key.

It is appreciated that the editing mode be established by activating the operator-controlled means.

The typewriter may comprise a printing start pointer which designates a group of character data representing a desired line of characters at which the printing of the text is started. The pointer designates said one of plural groups of the character data which is selected by the operator-controlled means, so that the printing is started at the line of characters displayed on the display.

In the case where the printing start pointer is provided, the second control means is operative in a single-line printing mode to print the desired line of charcters represented by the group of character data which has been designated by the pointer. In this instance, it is appreciated that the keyboard comprise a first function key and a second function key which, when activated simultaneously, cooperate to establish the single-line printing mode.

BRIEF DESCRIPTION OF THE DRAWING

The above and other objects, features and advantages of the present invention will be better understood from reading the following description of a presently preferred embodiment of the invention taken in connection with the accompanying drawing in which:

FIG. 3 is a flow chart illustrating the operation of the typewriter.

DETAILED DESCRIPTION OF THE PREFERRED EMBODIMENT

Figure 1:
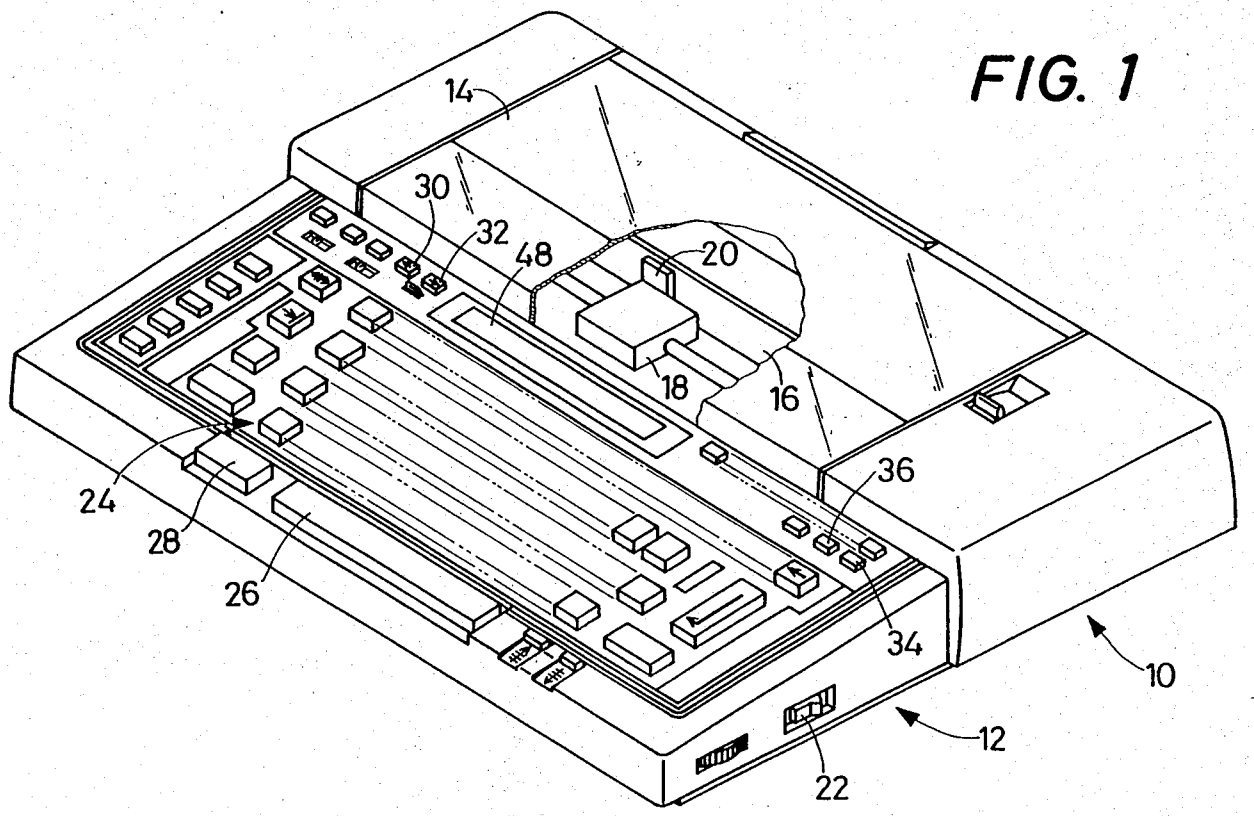
FIG. 1 is a perspective view depicting one embodiment of an electronic typewriter of the present invention.

Referring to FIG. 1, an electronic typewriter suitable for implementation of the present invention comprises a printing assembly 10 and a keyboard assembly 12. The printing assembly 10 includes a platen 16 which is located below a transparent covering plate 14 and supported by a frame of the assembly. The printing assembly 10 further includes a carriage 18 which is movable parallel to the length of the platen 16. The carriage 18 carries a print head 20 fixed thereto. The print head 20 is reciprocated with the carriage 18 along the platen relative to a sheet of paper held on the platen 16, and thereby effects printing operations to print lines of characters such as letters and symbols in predetermined order, to prepare a desired document. The transparent covering plate 14 is pivotable about its rear edge between its closed position of FIG. 1, and its open position at which the plate 14 is slightly inclined rearwardly from its upright position, and serves as a paper guide for supporting the sheet of paper.

The keyboard assembly 12 includes a power on-off switch 22 on the right-hand side of its casing, and a multiplicity of keys on the top surface of the casing. These keys include alphabetic keys 24, and various function keys such as a SPACE key 26 (space bar), a CODE key 28, a LEFT CURSOR key 30, a RIGHT CURSOR key 32, a STOP key 34, a CONTINUE key 36. In the rear central part of the keyboard assembly 12, there is incorporated a mutilple-digit display 48 (of 16-digit capacity, for example) which indicates characters such as alphabetic letters and symbols that are stored at appropriate locations of a TEXT memory referred to later.

Figure 2:
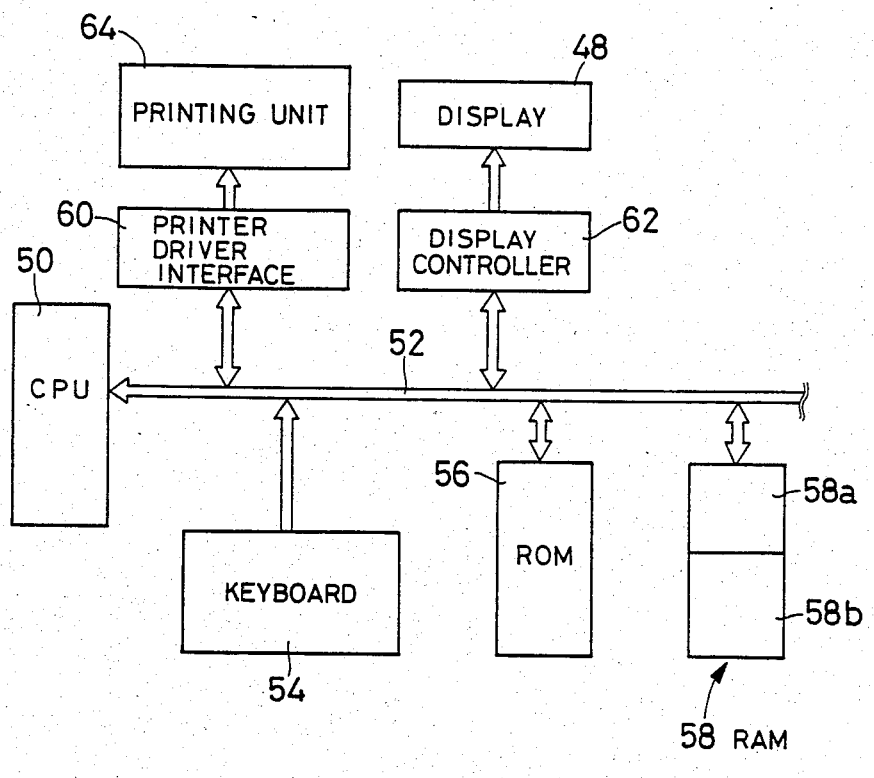
FIG. 2 is a block diagram showing the general circuit arrangement of the typewriter of FIG. 1.

The electronic typewriter with the aforementioned structural arrangement employs a control system as illustrated in FIG. 2, wherein a central processing unit 50 (hereinafter referred to as CPU 50) is connected, via a data bus line 52, to a keyboard 54, a read-only-memory 56 (hereinafter referred to as ROM 56), a random-access-memory 58 (hereinafter called RAM 58), a printer driver interface 60, and a display controller 62, which are all built in the keyboard assembly 12. By utilizing a temporary storage function of the RAM 58 and according to a program stored in the ROM 56, the CPU 50 processes output signals from the keyboard 54, and controls the printer driver interface 60 to actuate a printing unit 64 which comprises the carriage 18, print head 20, etc. disposed within the printing assembly 10. Thus, the printing unit 64 is operated to print on a sheet of paper a succession of characters in the predetermined order. The CPU 50 further serves to control the display controller 62 to actuate the display 48 for indication of the selected characters. The RAM 58 serves as memory means which has a FORMAT memory **58*a* and a TEXT memory 58*b*. The FORMAT memory 58*a* stores various format data associated with arrangement of characters, such as margin position data and tab setting data. The TEXT memory 58*b* stores printing data which includes a batch of character data representing characters in the order of printing. The printing data further includes the above-indicated format data, and other data representing, for example, a carriage return (line feed). These format and other data, and the character data, which constitute printing data for a text or document, are arranged in suitable order in the TEXT memory 58*b*. The term "character data" is interpreted to include not only the character data representative of alphabetic letters, numerals (digits) and symbols, but also space data representative of a space between characters, which space data therefore controls the printing position of characters. In essence, the character data is associated with movements of the carriage 18**, and the execution of any character data required or involves a change of the printing position.

Referring to a flow chart of FIG. 3, there will be described the operation of the electronic typewriter with the structural and control arrangements which have been described hitherto.

Upon power application by operating the power on-off switch 22, the CPU 50 executes an initializing routine (not shown) wherein various counters, registers and the like are cleared. By simultaneously activating the CODE key 28 and the LEFT CURSOR key 30, or the CODE key 28 and the RIGHT CURSOR key 32, an upward or downward scrolling of lines of characters of the stored text is effected to select a desired line of characters. With the desired line of characters selected by scrolling of the stored text, the leading set of characters (16 successive characters including a space) of the selected line is indicated on the display 48. This scrolling action selecting a desired line of the text establishes an EDIT mode in which addition and deletion of characters, and other editing operations may be performed. In other words, the EDIT mode is established by simultaneous activation of the CODE key 28 and one of the CURSOR keys 30, 32. Further, the scrolling action by use of the above indicated two keys 28 and 30 or 32 is executed when it is desired to print a selected line, or successive lines beginning at the selected line, as will be described in greater detail. Thus, in this specific embodiment, the CODE key 28, and the CURSOR keys 30 and 32 constitute a part of designating means for designating a line of characters which is to be edited or printed, or a line at which a printing operation is started.

With the leading characters of a desired line of the text displayed, the CPU 50 executes step S1 to check if a TEXT PRINT mode is currently established or not. The TEXT PRINT mode is established when any one of the following three printing modes is selected: ENTIRE-TEXT printing mode; PARTIAL printing mode; and SINGLE-LINE printing mode. If the TEXT PRINT mode is not established, the CPU 50 executes predetermined processing operations which are not directly associated with the subject matter of the invention. If the TEXT PRINT mode is currently established, the CPU 50 goes to step S2 to check if the ENTIRE-TEXT printing mode is currently established or not.

"ENTIRE-TEXT" Printing Mode

If, for example, the ENTIRE-TEXT printing mode is established by simultaneous depression of the alphabetic key 24 corresponding to letter "P" and the CODE key 28, step S2 is followed by step S3 to cancel the EDIT mode. In the following step S4 of checking if the EDIT mode is currently established, therefore, the CPU 50 judges that the EDIT mode is not established, and consequently goes to step S5. In this step Step S5, the CPU 50 sets a printing start pointer at a first group of character data representative of a first line of a text stored in the TEXT memory **58*b*. The printing start pointer designates a line of characters at which the printing is started. Step S5 is then followed by step S6 wherein the CPU 50 checks to see if the SINGLE-LINE printing mode is selected or not. Since the ENTIRE-TEXT printing mode has been established in this example as indicated above, the checking in step S6 reveals that the SINGLE-LINE printing mode is not currently selected. Hence, the CPU 50 goes to step S7 to print all lines of characters represented by corresponding groups of character data including and following a group of character data which has been designated in step S5 by the printing start pointer. That is, since the first group of character data corresponding to the first line of the stored text was designated in step S5 by the printing start pointer, the entire text of the document stored in the TEXT memory 58***b* is printed in step S7. Thus, control means for executing steps S5 and S7 are considered to constitute first printing control means for printing the entire text of a document stored in the TEXT memory 58*b*.

"PARTIAL" Printing Mode

If, on the other hand, the PARTIAL printing mode is established by depressing the CONTINUE key 36, the CPU 50 goes from step S2 to step S4 because the ENTIRE-TEXT printing mode is not selected. Described in more detail, the CPU 50 skips step S3 of cancelling the EDIT mode which has been established by the scrolling action carried out in the initial stage of operation prior to the execution of step S1, as previously stated. As a result, the CPU 50 judges in step S4 that the EDIT mode is currently established, and therefore enters step S8 wherein the CPU 50 sets the printing start pointer at a group of character data representing a desired line of the stored text, which desired line was selected by the previously performed scrolling action by means of simultaneous operations of the CODE key 28 and the LEFT or RIGHT CURSOR key 30, 32. In other words, the printing start pointer is set to designate a line of characters which is at least partly (16 characters in this example) indicated on the display 48.

Upon completion of the pointer setting operation in step S8, the CPU 50 then goes to step S6 to see if the SINGLE-LINE printing mode is currently selected or not. As the PARTIAL printing mode was previously selected, the CPU 50 judges in step S6 that the SINGLE-LINE printing mode is not currently selected, and therefore goes to step S7 wherein the line of the text designated by the pointer, and the remaining lines following the designated line are all printed. Thus, the PARTIAL printing mode is used when it is desired to start the printing, from a line part way through the text, that is, beginning at a desired line which is designated by the operator by scrolling operations.

"SINGLE-LINE" Printing Mode

When it is desired to print only a desired single line of the stored text, the CODE key 28 and the CONTINUE key 36 are simultaneously depressed in order to establish the SINGLE-LINE printing mode. In this condition, step S2 is directly followed by step S4, with step S3 skipped as in the PARTIAL printing mode. As the previously established EDIT mode is not cancelled in step S3, step S4 is followed by step S8, wherein the printing start pointer is set at a group of character data representative of a desired printing line which was selected by the operator through the scrolling operation. Successively, the CPU 50 executes step 56 to see if the SINGLE-LINE printing mode is selected. As the SINGLE-LINE printing mode is currently established, step S6 is followed by step S9. In this step, the CPU 50 controls the printer driver interface 60 so as to print only the line of characters represented by the group of character data which has been designated in step S8 by the printing start pointer. Thus, in this embodiment, control means for executing steps S8 and S9 are considered to constitute second printing control means for printing only a desired single line of a text stored in the TEXT memory 58*b*.

As described hitherto, the illustrated embodiment of an electronic typewriter of the present invention is capable of printing a selected single line of a text which is stored in the TEXT memory 58*b* of the RAM 58 in the form of plural groups of character data corresponding to plural lines of characers. This selective printing capability is conveniently used when it is desired to print out a single set of information from among multiple groups of information each consisting of a relatively short line of successive characters which are represented by a corresponding group of character data stored in a memory. Further, it will be understood from the foregoing description that control means for executing steps S8 and S7 are considered to constitute third printing control means for performing a printing operation in the PARTIAL printing mode, wherein the printing is started at the line which is designated by the printing start pointer, i.e., at the line displayed on the display 39.

While the present invention has been described in its preferred form for illustrative purpose only, it should be appreciated that various modifications and variations of the invention are possible within the spirit and scope of the invention defined in the appended claims.

We claim:

1. An electronic typewriter with data storing and editing capability, comprising:

keyboard means, having character keys and function keys, for entering printing data including character data representative of a text, said keyboard means having at least one cursor key;

text memory means for storing said printing data entered through said keyboard means;

printing assembly means operated according to the printing data stored in the text memory means, for printing said text;

display means for displaying at least a portion of a line of characters represented by one of plural groups of the character data which represents corresponding plural lines of characters constituting said text, said display means effecting a vertical scrolling operation by simultaneous activation of one of said function keys and one of said at least one cursor key, to select said one of plural groups of the character data, and thereby displaying the corresponding line of characters, said display means including means responsive to the simultaneous activation of said one function key and said one cursor key for establishing an edit mode in which said corresponding line of characters displayed on said display means may be edited;

first printing control means, operative in an entire-text printing mode, for controlling the operation of the typewriter so as to cause said printing assembly means to print all lines of characters of said text stored in said text memory means;

second printing control means, operative in a single-line printing mode, for controlling the operation of the typewriter so as to cause said printing assembly means to print only said corresponding line of characters; and third printing control means, operative in a partial-printing mode and in said edit mode, for controlling the operation of the typewriter so as to cause said printing assembly means to print said corresponding line of characters displayed on said display means, and all of the remaining lines of said text following the displayed lines.

2. The electronic typewriter of claim 1, further comprising a printing start pointer means for designating a desired line of characters at which the printing of said text is started, said pointer means designating, when the typewriter is in said single-line printing mode, said one of plural groups of the character data which is selected by said one function key and said one cursor key.

3. The electronic typewriter of claim 2, wherein when the typewriter is placed in said entire-text printing mode, said printing start pointer means designates a first group of the character data representative of a first line of characters of said text.

4. The electronic typewriter of claim 1, further comprising a printing start pointer means for designating a group of the character data representing a desired line of characters at which the printing of said text is started, said pointer means designating, in said partial-printing mode, said one of plural groups of the character data which is selected by said one function key and said one cursor key.

5. The electronic typewriter of claim 1, wherein said function keys on said keyboard means comprise a first function key and a second fuction key which, when activated simultaneously, cooperate to establish said single-line printing mode.

* * * * *